US008052022B2

(12) United States Patent
Marks

(10) Patent No.: US 8,052,022 B2
(45) Date of Patent: Nov. 8, 2011

(54) LEVERAGED ACTION STAPLER

(75) Inventor: Joel S. Marks, Sherman Oaks, CA (US)

(73) Assignee: Worktools, Inc., Chatsworth, CA (US)

( * ) Notice: Subject to any disclaimer, the term of this patent is extended or adjusted under 35 U.S.C. 154(b) by 14 days.

(21) Appl. No.: 12/639,934

(22) Filed: Dec. 16, 2009

(65) Prior Publication Data

US 2011/0139850 A1 Jun. 16, 2011

(51) Int. Cl.
*B25C 5/11* (2006.01)

(52) U.S. Cl. ..... 227/129; 227/134; 227/120

(58) Field of Classification Search ..... 227/120, 227/124, 125, 127, 128, 129, 134
See application file for complete search history.

(56) References Cited

U.S. PATENT DOCUMENTS

| | | | | |
|---|---|---|---|---|
| 2,859,443 | A | 11/1958 | Jopp | |
| 3,524,575 | A | 8/1970 | Hurkmans et al. | |
| 3,958,738 | A * | 5/1976 | Tremblay | 227/109 |
| 5,328,075 | A | 7/1994 | Marks | |
| 5,356,063 | A * | 10/1994 | Perez | 227/132 |
| 5,704,533 | A * | 1/1998 | Chang | 227/124 |
| 6,145,728 | A | 11/2000 | Marks | |
| 6,550,661 | B2 | 4/2003 | Aoki | |
| 6,702,172 | B1 | 3/2004 | Hakansson | |
| 7,080,768 | B2 | 5/2006 | Marks | |
| 7,124,922 | B2 | 10/2006 | Marks | |
| 6,966,479 | B2 | 11/2006 | Matsukawa | |
| 7,234,621 | B2 | 6/2007 | Marks | |
| 7,243,832 | B2 * | 7/2007 | Jiang | 227/120 |
| 7,322,504 | B2 | 1/2008 | Chen | |
| 7,334,716 | B2 | 2/2008 | Tsai | |
| 7,395,955 | B2 * | 7/2008 | Zins et al. | 227/132 |
| 7,513,406 | B2 | 4/2009 | Marks | |
| 7,540,400 | B2 | 6/2009 | Zins et al. | |
| 7,584,878 | B2 * | 9/2009 | Kandasamy | 227/120 |
| 7,665,643 | B2 * | 2/2010 | Huang | 227/128 |
| 7,690,545 | B2 * | 4/2010 | Co | 227/125 |

(Continued)

FOREIGN PATENT DOCUMENTS

WO 2008041529 4/2008

(Continued)

OTHER PUBLICATIONS

Novus product brochure for model B8FC Stapler Power On Demand feature.

(Continued)

*Primary Examiner* — Rinaldi Rada
*Assistant Examiner* — Eyamindae Jallow
(74) *Attorney, Agent, or Firm* — Paul Y. Feng; The Eclipse Group LLP

(57) ABSTRACT

A stapler selectively uses enhanced leverage to break a glue bond of a staple to separate the staple from a rack of staples in the stapler. The staple does not press a working surface during this operating stage. The extra leverage stage occurs through a minority of total handle travel, preferably via a pivoting lever linked to the striker at one end and the opposite end traversing between inner spaced apart ribs underneath the handle. A remaining non-leveraged handle travel stage ejects a staple out from the stapler body against a working surface. A track supports staples from an underside of the top of the staples. The track includes an outward extending bottom support for at least one staple on the track to prevent rotation of a short rack of staples.

13 Claims, 4 Drawing Sheets

U.S. PATENT DOCUMENTS

| | | | | |
|---|---|---|---|---|
| 2007/0057011 | A1* | 3/2007 | Kandasamy et al. | 227/134 |
| 2007/0251970 | A1* | 11/2007 | Cox | 227/120 |
| 2009/0120993 | A1 | 5/2009 | Kandasamy et al. | |
| 2009/0159636 | A1 | 6/2009 | Shen | |
| 2010/0314431 | A1* | 12/2010 | Wang | 227/120 |

FOREIGN PATENT DOCUMENTS

| | | |
|---|---|---|
| WO | 2008052457 | 5/2008 |

OTHER PUBLICATIONS

Novus product brochure for model Flat Clinch Stapler S4FC.
Staples DX-3 Enhanced Leverage Stapler, from website.
Swingline Light Touch Reduced Effort Stapler, from website.
Swingline Optima 70 Reduced Effort Stapler, from website.
Swingline Optima 40 Reduced Effort Stapler, from website.

* cited by examiner

LEVERAGED ACTION STAPLER

FIELD OF THE INVENTION

The present invention relates to a reduced force stapler. More precisely, the present invention relates to a preferably partially leveraged actuating system in a stapler.

BACKGROUND

Conventional direct acting staplers are well known for fastening papers and other tasks. The handle is linked directly to the striker so that, above the striker, the handle moves the same as or similarly to the striker. Such staplers are sometimes known as a direct action stapler. For example, in a direct action stapler, a striker commonly moves about ½ inch to eject and install a common 26/6 type or similar staple. In this example, the handle near the striker moves toward the body about the same ½ inch as it is pressed through its complete stroke. Such staples can be used to fasten more than 20 sheets of 20 lb. type paper. But they are commonly used for fewer sheets, five or less for example.

Such conventional staplers are known to require high pressing forces to operate. Part of the effort is to separate a front staple from the rack of staples held inside the stapler. In this process, the glue that holds the staple stick or rack together must be sheared to free the front staple. When the glue is weak this effort is not excessive. But when the glue is strong, shearing the glue is often the largest factor in pressing effort, particularly in low sheet counts. The variation in glue accounts for much of the unpredictability in conventional stapling. In some cases, glue shearing can require 15 lbs. of force just to allow the handle to start moving. A well-known way to generate sufficient force to overcome this problem is to bang the handle with a clenched fist.

To reduce any need to bang the hand with the fist and to ease the stapling process, the handle may be less directly linked to the striker to allow reduced effort operation. For example, the handle may operate to energize a power spring. At a pre-release position of the handle the spring suddenly ejects and installs a staple. In this manner, the force peaks through the fastening operation are reduced. The impulse or shock overcomes the glue shear force among others. Further, the handle may move more than the striker for enhanced leverage.

Another option to reduce stapling effort employs extra leverage. For example, a handle may extend well past a front of the stapler body to provide a simple, longer lever to add handle travel to the action. The base of such a stapler must correspondingly extend forward to the front end of the handle to provide a reaction location for the very forward force application. A further mechanism allows a shorter device by linking a base to the handle through a multi-link system. This link effectively compresses the body between the handle and the base to hold the body against the base. In this design, pressing the handle toward the body causes the base to move up toward the body even if the base is not being touched. This is one way to observe such conventional leveraged action. The first leverage option is a long device that is not convenient on a desktop. The second device requires a complex mechanism.

In both examples the base is integral to the function of enhanced leverage. Therefore, neither of these devices allows for use as a tacker with the base opened. The long handled stapler would tip forward without its long base. The handle-to-base linked version has the body rising away from the work surface as the staple exits if there is no base under the staple.

This is because the force by the staple on the work surface is leveraged by design to be more than a force upon the handle above the striker. For example, a 10 lb. handle force may by leveraged to become a 20 lb. staple exit force. This net imbalance moves the body away from the work surface toward the handle with a force of 10 lbs. If the base is linked to the body as in common leveraged staplers then the body cannot move away from the base. But as discussed above, the base must then be the working surface. In contrast, a conventional non-leveraged stapler has the force by the staple being substantially the same as the force acting on the handle; there is no net vertical force on the body.

The handle-to-base link requirement has not been apparently addressed by non-spring actuated staplers. In a spring actuated stapler, the body does not move away from any working surface even as the handle can be leveraged to the striker through the spring. This is because the fastening operation occurs instantly; the momentum from the mass of the body holds the body in its operative position during this instant action.

SUMMARY OF THE INVENTION

In the present invention, a simple stapler provides reduced effort. In contrast with the prior art non-spring powered leveraged staplers, the stapler of the present invention does not require the base in the operation of the leveraging mechanism. The staple does not press the base away, or at all, during the leveraged motion of the striker and staple. Therefore, the base or its equivalent structure and handle do not need to clamp the body between them as required in conventional leveraged staplers.

In one preferred embodiment of the present invention, enhanced leverage is selectively applied to an initial portion of an operating stroke corresponding to glue shearing of the staple rack. The remaining stroke after that initial portion is not substantially leveraged, retaining an approximate 1:1 handle to striker motion with respect to a location on the handle above the striker. As used in this disclosure, 1:1 means approximately 1:1 relative motion of the striker and handle since tolerances in manufacture and use of the device will necessarily be imprecise. For example, among other factors there may be free play between the handle and the striker that allows some separate motion of the handle to the striker. If desired, a ratio less than 1:1 may be used for the remaining stroke wherein the handle moves more slowly than the striker.

The enhanced leverage occurs preferably entirely while the staple is within the body of the stapler. Since the staple does not extend from the body, there is no exposure or contact to the base through the leveraged motion. Therefore, the base is not directly involved in an action upon the staple. This portion of the striker travel may be short. The enhanced leverage occurs at least from a position that the striker contacts the staple top surface until the glue bond of the staple is broken. A very slight motion of the staple will normally break the bond. For example, the striker may move itself and the staple, after the striker first contacts the staple, about 0.015 to 0.020 inch to break the bond. In practice, the actual motion the high leverage stage will be more than this distance. Specifically, a striker highest position is just high enough, including manufacturing and staple tolerances, so that a staple can move under it to be ejected. So the enhanced leverage may also include a striker motion from the highest position to the staple contact position. For example, a total leveraged motion of the striker of about 0.050 to 0.060 inch inclusive may be preferred to provide for an initial motion to contact the staple and a further motion past a minimum to fully and reliably break the bond. Optionally, the striker may be leveraged until a staple is just about or slightly extended out from the body.

The non-enhanced, or 1:1, motion occurs at least when the staple extends out from the body. The 1:1 motion stage normally includes at least some striker movement after the glue bond is broken, but while the staple is still within the body. The 1:1 motion normally next involves striker motion corresponding to penetration of the paper or other object by the staple legs, and folding the legs by the anvil or equivalent structure when such structure is present.

If the stapler of the invention is used as a tacker, the benefits are still present. Especially, but not exclusively, if a conventional stapler is used to tack against a soft material such as a bulletin board, then the glue shearing may be the most difficult part of the operation. The leveraging stage of the invention reduces such effort. Penetrating a soft substrate by comparison will be relatively easy, requiring a low operating force in a non-leveraged stage. As discussed above, the base is not directly involved in the leveraging action and so the stapler of the invention is useful in tacking.

Optionally, the leveraging action of the present invention may be incorporated into a flat clinch anvil design. In such a design, a cam within the anvil operates on the staple legs to fold as a separate action from pressing the staple downward. The handle may be linked to the base for the purpose of triggering or actuating the anvil cam. But motion of the handle, relative to the body, is not linked to motion of the base to cause substantial pressing of the body against the base. Such a link does not counteract a force imbalance as discussed above.

Another feature of the invention includes a simplified track assembly with a staple shear off tab integrated into the structure of the track. In the preferred embodiment, the track supports the staples from top rails. As discussed above, this design may be simpler in construction and allows convenient bottom loading. Bottom loading is effective for jam resistance; the staple chamber can be fully exposed to clear any jams. But to prevent rotation of the staple rack, at least one side of the rack should be supported from below the leg at the front end of the track. According to the invention, this support is preferably provided within the structure of a rail type track.

DETAILED DESCRIPTION OF THE PREFERRED EMBODIMENTS

Figure 1:
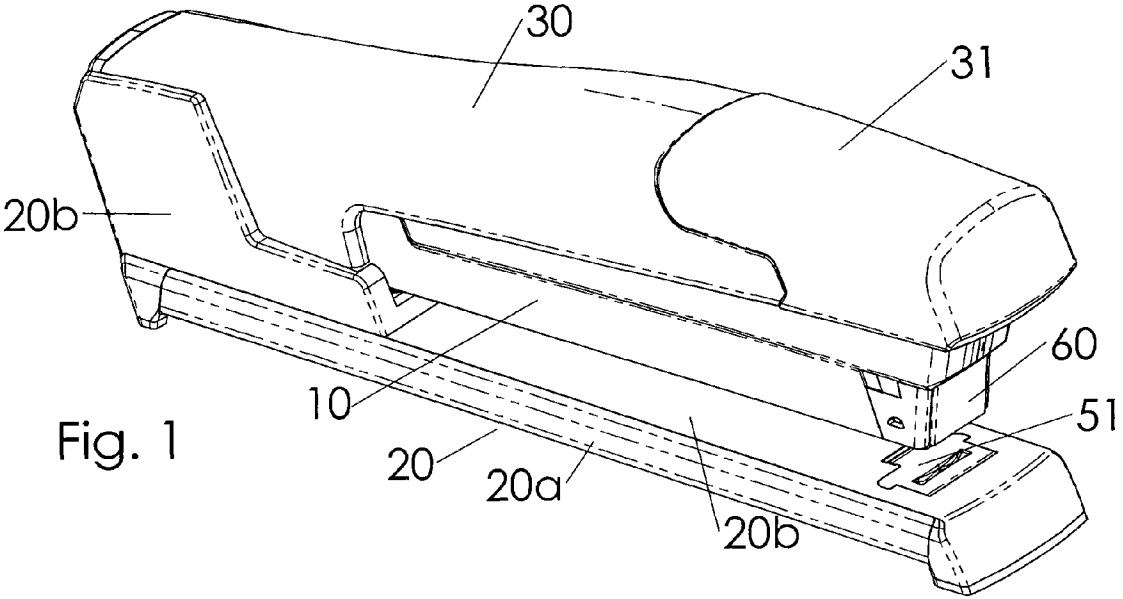
FIG. 1 is a right, top perspective view of a preferred embodiment stapler according to the present invention.
Figure 13:
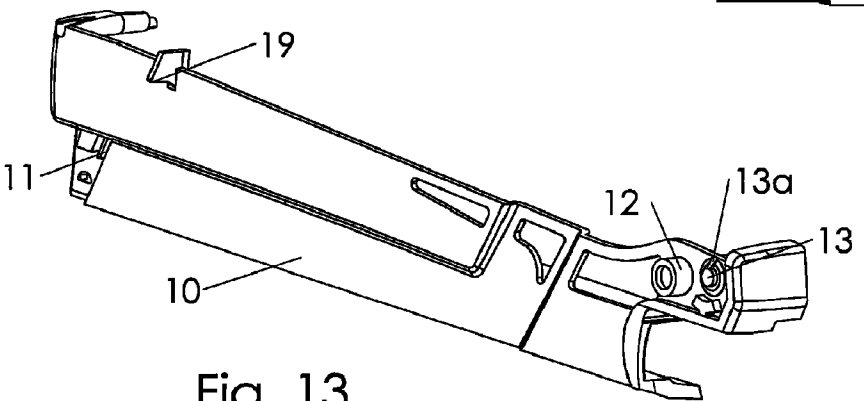
FIG. 13 is a rear perspective view of a left housing half of the stapler.

FIG. 1 shows an external view of a preferred embodiment of the invention. The stapler includes body 10, handle 30 on a top of the body, and base 20. Body 10 may be formed of two housing halves as seen in FIG. 13. Base 20 normally extends along a bottom of the body 10. Handle 20 is depicted in an upper rest position. Optional handle portion 31 may be a molded cover for handle 30.

Figure 2:
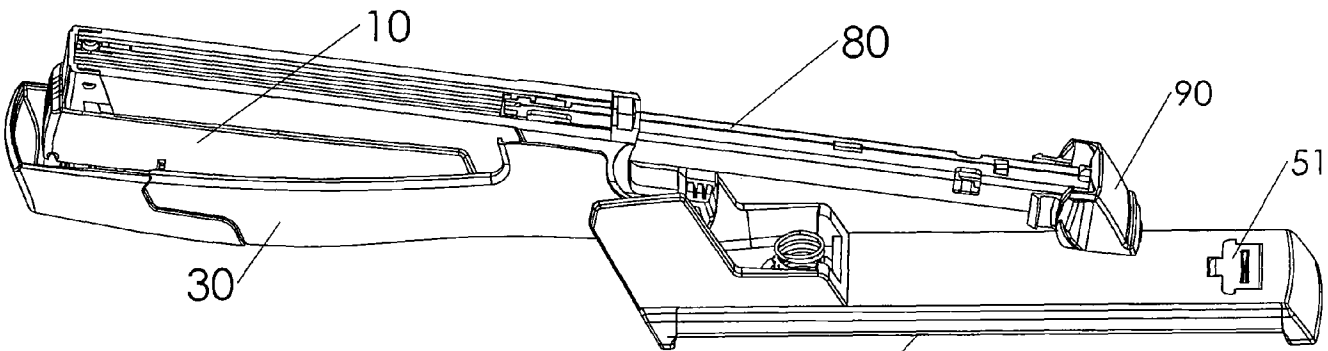
FIG. 2 is the stapler of FIG. 1 in an opened position for loading staples.

FIG. 2 shows the preferred embodiment stapler in an opened position. Body 10 pivots about base 20 to extend rearward from the base 20. Track assembly 80 is slid open to expose a staple chamber within the body 10. Base 20 includes anvil 51 for forming staples behind the paper stack to be fastened. Nosepiece 60 may be fitted to the front of the body 10 to hold the housing halves together.

Figure 12:
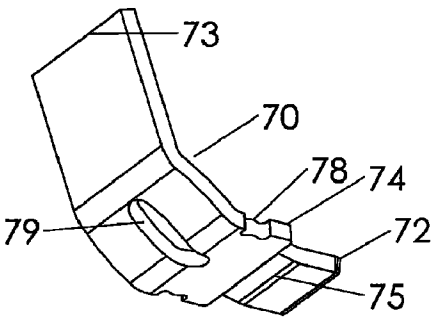
FIG. 12 is a rear perspective view of a lever of the stapler of the invention.

FIGS. 3 to 6 show elements of the preferred embodiment leveraging features of the invention. In the preferred embodiment shown in FIG. 12, lever 70 is a flat piece of material that has an open U shape in a profile view, with a relatively flat middle section and raised, wing-like ends. Other shapes of the lever may be used such as straight bar or U-channel, for example. Lever 70 acts on striker 100 between body 10 and handle 30. This preferred shape enhances the pivoting and fulcrum functions.

In the illustrated embodiment, handle 30 is a sheet metal structure with front portion 31 being molded plastic. Front portion 31 includes structures of the leveraging mechanism. The term handle 30 may be used interchangeably with optional portion 31 to describe any part of the handle 30. Lever 70 pivots at front end 72 upon fulcrum 12 of body 10. Lever 70 further pivots upon lever fulcrum 34 of handle 30 at fulcrum area 74. The lever 70 may include locating notch 78 or equivalent structure (see also FIG. 12) wherein snaps or undercuts or similar structure 33 of handle 30 hold the lever 70 up in position against lever fulcrum 34.

Figure 4:
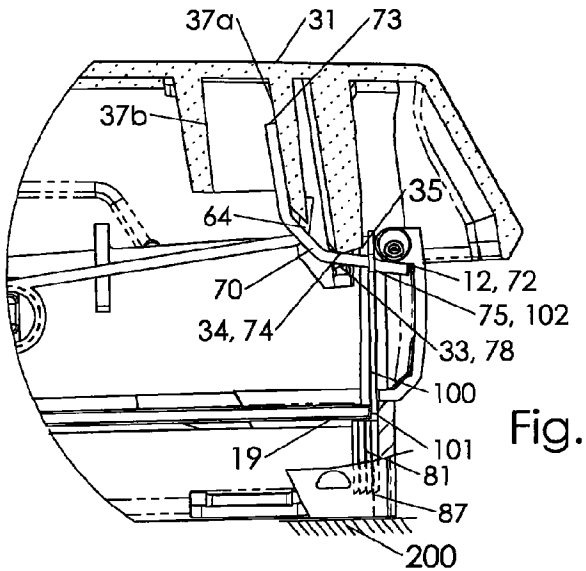
FIG. 4 is an enlarged side detail view of the stapler of FIG. 3 in a rest configuration.

In FIG. 4, the stapler is shown in an upper rest position with striker 100 at or near its highest position. Bottom edge 101 of striker 100 is spaced above staples 81, preferably immediately above track ceiling 19 of a track chamber. This spacing is far enough to ensure that staple rack 81 can reliably advance under the striker. For example, striker bottom edge 101 may be preferably about 0.02 inch above a top of staple rack 81. This distance may range from about 0.01-0.03 inch in alternative embodiments. Lower staple leg point 87 is above the bottom of the body 10, confined or surrounded by the body 10 including nosepiece 60 as illustrated. Lever rear 73 contacts rib 37*a* of the handle 30 in the rest position of FIG. 4. Striker 100 includes slot 102 through which lever 70 extends at striker fulcrum 75. Still in FIG. 4, handle 30 cannot move farther upward since lever 70 is stopped against fulcrum 12 and cannot rotate farther clockwise. As illustrated, a reset spring is a torsion type with a coil 62 and forward arm 64. Arm 64 extends through opening 79 of the lever 70 (FIG. 12), wherein arm 64 biases and presses upward on lever 70 and thus handle 30. By pressing on lever 70, the reset spring ensures that lever 70 is fully rotated to its rest position of FIG. 4.

Figure 3:
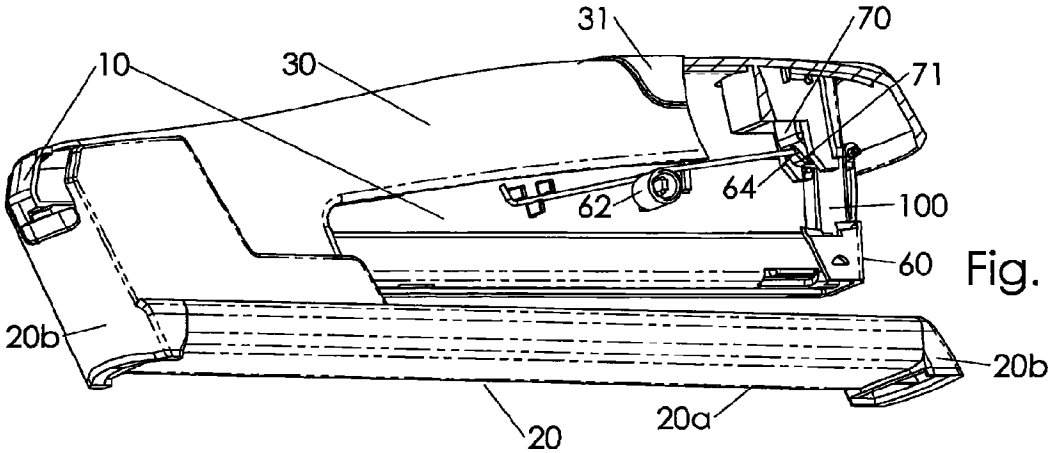
FIG. 3 is a bottom, rear perspective view of the stapler of FIG. 1 with a right housing half removed to expose the interior.

A further effect of this arrangement of the reset spring is to bias the lever 70 to rotate clockwise in the views of FIGS. 3, 4. This is not a strong bias in the particular geometry shown because arm 64 presses near to fulcrum area 74 of handle 30. This bias could be larger for example if arm 64 engaged lever 70 at a more rearward location of the lever 70 to create a longer torque arm along the lever. This spring bias may provide a shock absorbing function to handle 30 as well, as perceived by the user. For example, in FIG. 5, staple 81*a* has sheared off the staple rack 81. There is minimal force needed to move this staple 81*a* a farther increment downward to a bottom of the body 10, wherein lower staple leg points 87 just start to press working surface 200. During this low force motion of the staple lever 70 may rotate clockwise (not shown) if other friction is minimal. Striker 100 moves slightly downward during this clockwise motion. A limit of the clockwise motion is when lever rear end 73 contacts rib 37*a*. In a more general concept, the lever can toggle between ribs 37*a* and 37*b* as handle 30 is pressed depending on the staple reaction force at striker 100. This action will reduce jerkiness at the handle known in direct type staplers through this stage since there is at least some force to react to throughout this motion as the lever quickly moves striker 100 downward. Working surface 200 may include papers, anvil 51, or other surface.

Optionally, the reset spring 62, 64 may press directly on handle 30. In this configuration, the toggle action described above will not normally occur. The reset spring may further be of other designs such as a compression spring, a bar spring, etc. For any reset spring design, or other resilient motions in the action, a link between the handle 30 and the striker 100 will be substantially if not entirely rigid during the leveraging stage; such a link includes the generally rigid lever 70 in the preferred embodiment. Lever 70 or equivalent structure may optionally have some resilience to store energy through small portions of an operating cycle, for example, to cushion shock in the handle as perceived by the user.

Alternatively, other locations of the lever 70 than rear end 73 may provide a stop. For example, an intermediate location of an alternative embodiment lever (not shown) may include the stop. In this case it is possible that fulcrum area 74 is at or near a rear of the lever. Further, in an alternative embodiment, the lever 70 may pivot against the body 10 behind striker 100 (not shown) rather than in front as shown. In this case fulcrum area 74 could be in front of striker 100.

Figure 5:
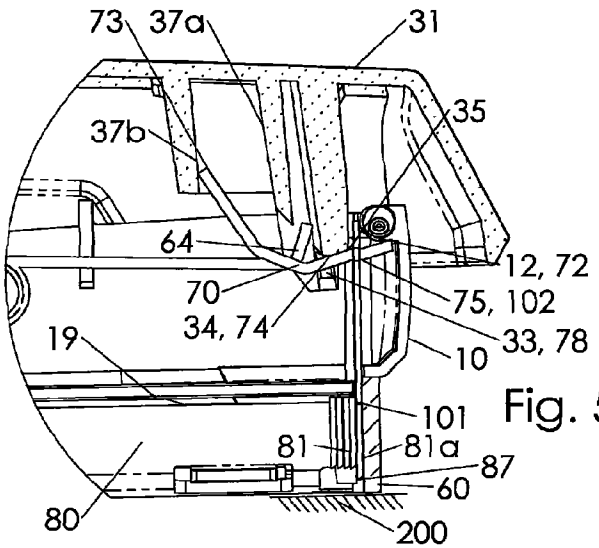
FIG. 5 is the stapler of FIG. 4 at an end of a leveraged stroke stage.

FIG. 5 shows an end of a leveraging stroke or stage. Lever 70 has rotated about front end 72 counterclockwise as depicted in FIG. 5 to a lever pressed position. Lever front end 72 does not substantially move vertically in body 10 during the leveraging stage. Rear end 73 contacts rib 37*b* of the handle 30 at the limit of rotation. This end of the leveraging stage, and the beginning of a non-leveraged stage, is preferably coincident with a pre-determined position of the handle 30 in relation to the body 10, and is a function of the lever position to the handle.

The lever 70 has also rotated, at fulcrum area 74, about lever fulcrum 34 of the handle 30. Staple rack 81 are positioned on track 80, including forward most staple 81*a*. Forward most staple 81*a* has been moved down enough to break its glue bond to the remaining staples of staple rack 81. However, staple 81*a*, including lower point 87, is still within the confines of body 10 as defined by a lowest point of nosepiece 60 in FIG. 5, or other nearby lower area of body 10. The leveraging step may end with a low point of the staple leg at the bottom of the body, or spaced slightly above the bottom as shown. As seen in FIG. 5, striker bottom edge 101 is slightly below track ceiling 19. At the end of the leveraging stage, striker bottom edge 101 will be below its highest position but substantially closer to track ceiling 19 than to the bottom of body 10; such position may be described as being near track ceiling 19. Track ceiling 19, or equivalent rib structure, is near to a top of the staple rack 81 and normally confines the staples from above. A total leveraged motion of the striker is in a range of about 0.050 to 0.060 inch inclusive of the end limits and all values within the limits is preferred to provide for an initial motion to contact the staple and a further motion past a minimum to fully and reliably break the bond between staples in the rack.

In the exemplary embodiment, the handle 30, nearly or directly above the striker 100, moves relative to the striker with a ratio of about 2:1 in the leveraging step. With a leveraging step ratio of about 2:1, the force at the handle to break the glue bond is about half (½) that of a conventional 1:1 handle-to-striker motion in this stage. For example, a 10 lb. force on the handle will provide a 20 lb. force on the staple.

At any point in the leveraging stroke, the staple 81*a* should not extend out from the body 10 in a manner that it substantially presses base 20 or other working surface 200. As such, the staple 81*a* is out of pressing contact with working surface 200. In describing the staple as being confined in the body or above a bottom of the body, this may include a condition that staple point 87 extends slightly out of the body 10 but does not extend far enough to create a significant force acting on the working surface 200. According to the preferred embodiment of the invention, the leveraging action acts on the striker 100 between the body 10 and the handle 30, exclusive of the base 20 or working surface 200. Therefore, motion of the handle 30 is de-linked from motion of the base 20, both motions being relative to the body 10. In contrast, conventional leveraged staplers link the base to the handle to press the body from below by the base.

As discussed earlier, a main cause of high effort in stapling is breaking or shearing the glue bond that holds the staples together, especially in common low sheet count use. According to the preferred embodiment of the invention, the force generated by the striker is leveraged only during or near the stage that such bond is broken. In this stage, the staple is normally entirely within the body of the stapler. As seen between FIGS. 4 and 5, the leveraging stage includes handle 30 moving only a minority of its possible total motion, for example, about 20-30%, while the majority of handle travel normally occurs between the positions depicted in FIGS. 5 and 6, the non-leveraged portion of the stapling cycle.

The non-leveraged part of the stapling cycle includes the about 1:1 relative handle-striker motion and occurs through a majority of the total handle travel. The force on the handle approximately matches that by the staple on a working surface. So the body has no net bias to move away from the working surface as discussed in the background section.

The handle 30 preferably includes a front corner or edge 35 adjacent to striker 100. In the lever pressed position of FIG. 5, edge 35 presses the lever, thereby moving the fulcrum area 74 to a more forward position on the handle 30 next to the striker 100. Specifically, front edge 35 is nearer to striker fulcrum 75 of the lever 70. Being next to the striker 100 provides that forces on the lever 70 are mostly shear rather than torsion as would occur by pressing the more rearward lever at fulcrum area 74. This avoids large bending moments in lever 70 and provides a sturdy connection for the 1:1 motion discussed further below.

Figure 6:
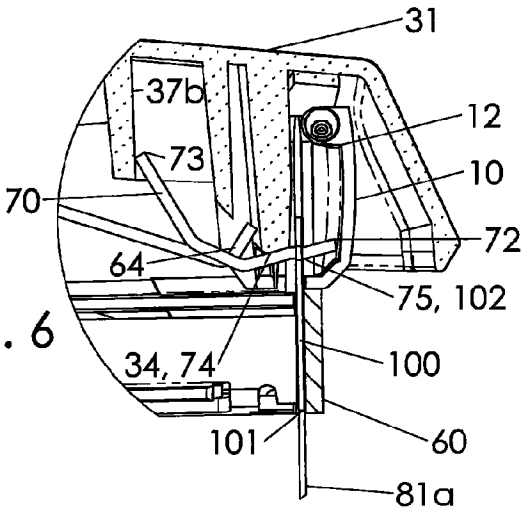
FIG. 6 is the stapler of FIG. 5 with the handle and striker in a lowest position.

In FIG. 6, the staple 81*a* is ejected out from body 10. The lever 70 remains in a substantially constant position from FIG. 5 relative to handle 30, becoming an effectively fixed structure or component of the handle other than any intentional or incidental minor resilience of the lever or nearby components. Motion is now primarily linear in the detail area shown in FIG. 6, with lever front end 72 moving downward along with striker 100 in body 10. Rear end 73 is held by rib 37*b* so that lever front end 72 no longer pivots about fulcrum 12. The assembly of handle 30 and lever 70 move together. The relative motion between the handle 30 above the striker 100 and the striker 100 is therefore about 1:1 between the positions of FIGS. 5 and 6. Striker 100 moves along with lever 70 to a lowest position as in FIG. 6. Striker bottom edge 101 is near the bottom of body 10. Staple 81*a* is urged or ejected out from the stapler into a working surface such as anvil 51 (FIG. 1). In FIG. 6, the staple is shown as it would appear when tacking without the base; with anvil 51 the staple 81*a* would normally become folded behind a paper stack (not shown) for example.

In summary, according to a preferred embodiment, a leveraging stage has the striker moving a short distance within the body, and an ejecting stage has the staple moving a majority of its travel in an operating cycle. Leveraging acts on the striker through a simple link, preferably a lever, between the handle and the body. The lever selectively pivots about a fulcrum of the body or moves away from such fulcrum along with the striker for respective operating stages. In the exemplary embodiment, no power spring acting on the striker is present. Preferably, linkages are substantially rigid connections without substantial energy storage. The leveraging system is thus a simple mechanism that provides an advantage over conventional direct action staplers with no additional complexity or bulkiness over such staplers.

Optionally, an initial short operational stage may include a 1:1 motion from the rest position of FIG. 4 until striker bottom edge 101 contacts the staples 81 since there are minimal force needs in this motion. For example, if it is desired to have a higher striker rest position, this option will reduce total handle travel required. But according to the preferred embodiment, at least the portion of the stroke that includes shearing of the staple glue has enhanced leverage. In the above example, a preferred leverage ratio of 2:1 is described. Alternatively, the leverage ratios may range from about 2.5:1 to about 1.5:1. Other ratios may be used in the glue shearing stage, for example about 3:2 or about 3:1. In all these examples, the handle moves a substantially faster rate than the striker relative to the body in the leveraging stage.

In the illustrated embodiment, leverage is provided preferably by an action of lever 70. Optionally, a series of levers (not shown) may provide this function. Further, a gear or pulley system (not shown) may link body 10 to handle 30 to provide leverage acting on striker 100. In all such configurations, the effect is equivalent wherein handle 30 moves faster than striker 100 during the leveraged stage of the present invention.

According to a preferred embodiment of the invention, the base is not linked to the handle to substantially press the body by the base through such link. However, the base may optionally be linked to the handle or other element of the stapler or staples to actuate a cam of the anvil for use in a flat clinch stapler. The cam may be part of a flat clinch design (not shown) wherein motion of the base toward the body causes a secondary cam motion to fold staple legs behind papers. For example, a specific position of the handle relative to the body or base may trigger the secondary cam motion. A flat clinch stapler can reduce stapling effort since there is less sliding of the staple legs against an anvil, and less bending action. However, flat clinch staplers using a conventional 1:1 handle/striker motion still require high peak effort to shear the staple glue. And flat clinch staplers of conventional leveraged design are complex in construction and bulky. A simplified design can reduce glue shear effort through selective leveraging according to the present invention, and anvil forming effort through a flat clinch action. Flat clinch mechanisms are shown in, for example, U.S. Pat. No. 6,702,172 (Hakasson) including FIGS. 1A to 1F, and U.S. Pat. No. 7,334,716 (Tsai), whose contents are incorporated by reference; and Novus brand (www.novus.de/buero) stapler part number S 4FC non-leveraged stapler and Novus brand B 8FC leveraged stapler.

A staple track may support a staple rack from either an inside rail under the top of the staples, or the floor beneath the legs of the staples, or a combination thereof. In a stapler, the front-most staple is unsupported from below in either case as it is cantilevered forward from the track to be within the striker slot at least at some point in an operating cycle. When the striker presses the unsupported front staple downward, a torque is created on that staple in relation to the remaining rack of staples glued to it. This effect is especially pronounced with short racks of, for example, two to six staples. The staple rack pivots about a front edge of the track to cause the legs to be biased rearward. In a spring-powered stapler, the staple is ejected quickly; the rotational effect is momentary and there is not enough time for any rotation to overcome momentum of the staple rack against such motion. In a non-spring powered stapler, this effect may be substantial since motions are relatively slow. When the staples are supported from below the legs, the rotation effect is minimal since the supported legs are pressed to the floor and friction there prevents the legs from sliding rearward during any rotation. But if the staples are supported from top edges of a rail the legs have no reaction surface and the rack can rotate; in some instances the legs can point substantially rearward. The staple then cannot easily be ejected.

In spring powered staplers, either track design is used. The top edge rail type track has an advantage that it may be of simpler construction and is well suited for bottom loading designs. But in a non-spring powered stapler, it is preferred to support the staples from beneath only. Other loading designs are known including top load, rear load, or front load.

Figure 10:
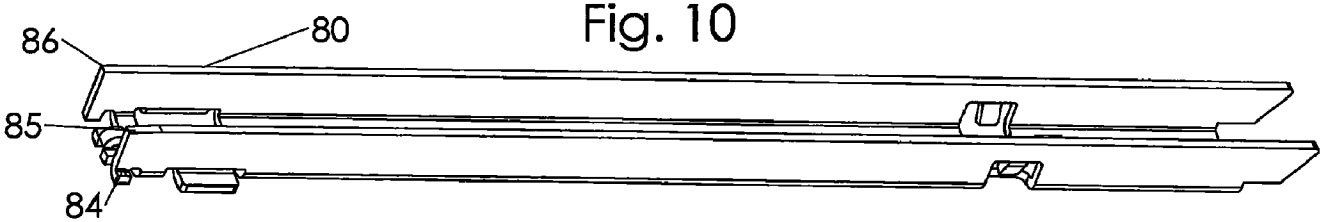
FIG. 10 is a top perspective view of a track of the stapler of the invention.
Figure 11:
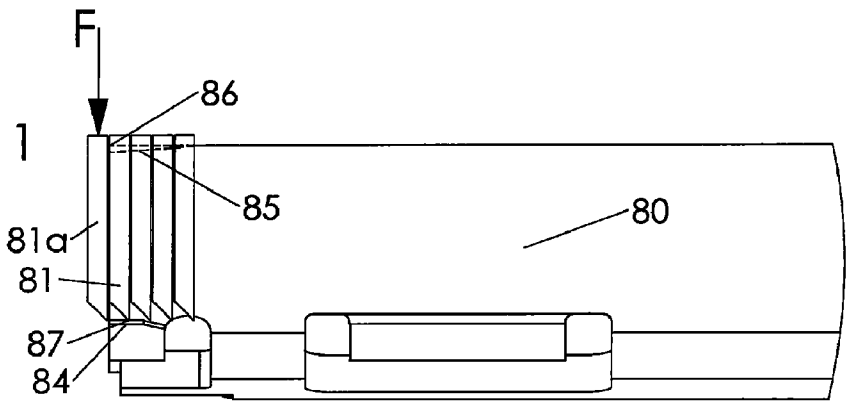
FIG. 11 is a side elevational detail view of a front end of the track of FIG. 10, including a short staple rack.

An optional feature of the present invention is an anti-rotation support for the staple rack. FIGS. 10 and 11 show a staple track 80 that supports staples from inside the rack by top rails, i.e., two parallel walls forming a channel shape of the track. In FIG. 11, a short rack of staples 81 is at the front of track 80. Front most staple 81*a* is cantilevered from the front end of track 80. Striker 100 (not shown) applies force F. When the top rails of track 80 exclusively support the staples, the staple rack 81 tends to rotate counterclockwise in FIG. 11 about corner 86 as cantilevered staple 81*a* is pressed. The staples can become jammed when so rotated. If instead some, or at least one of the front staples is supported from below, the staple rack 81 cannot rotate. Lower point 87 is pressed to outward extending tab 84 (FIGS. 10, 11). The resulting friction, spaced substantially away from the force application point, creates a rigid structure in the staple rack 81 and prevents rearward movement of the lower leg of the staple or staples that contact tab 84.

In conventional staplers, a track (not shown) encloses the staple rack entirely from outside and below rather than from inside by top rails. In this outer type staple track, the staple rack does not rotate because the legs are supported from below. However, this type of track is not suited for the present invention loading design as shown in FIG. 2. For example, this track is wider than the staples and there is no efficient way to center the rear most staple of a rack within the wide channel of this track as the track is slid forward to the closed position. The front edge of this track would jam against the rear staple unless the rack is well centered. In contrast, the preferred embodiment top rail type track (FIGS. 10, 11) is narrower than the staple rack and is thus always centered in the position of FIG. 2 within a channel naturally formed by the staple rack. In the position of FIG. 2, it is easy to fix a jammed staple condition because the entire staple chamber of the body is exposed. Further, the preferred embodiment top rail type track is a very simple construction.

Therefore, according to the preferred embodiment, top rail track 80 of FIG. 10 includes a tab 84 extending outward from a wall of the track 80 to provide an optional bottom support for one or more staples in a staple 81 rack. It has been shown empirically that at least one tab 84 provides sufficient anti-rotation function for the staple rack; it is therefore not required to have tabs 84 on both sides. Of course, optionally there may be two or more opposed tabs or equivalent structures.

Track 80 includes an optional chamfered front corner 85 to present a lowered rail above the location of support tab 84. Having a chamfered front corner 85 allows for manufacturing variations and tolerances in the staples and track yet ensures that lower point 87 of staples 81 always presses tab 84 rather than the top rail at the front of the track as the striker applies force F (FIG. 11).

Figure 8:
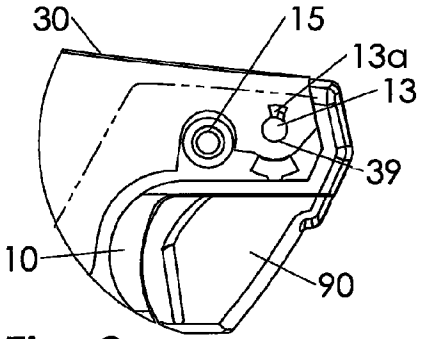
FIG. 8 is a detail view of a rear area of the stapler of FIG. 7 with the base depicted in phantom lines to expose further components.

In FIG. 8, body 10 pivots about base 20 at body post 15. Track pull 90 is attached to track 80. In the closed track position, track pull 90 is preferably at least partially surrounded by base 20 (FIG. 3).

FIG. 8 shows a detail of a snap fitted handle. That is, handle 30 may be of sheet metal construction in this area, or optionally of plastic or die cast material. Opening 39 of the handle fits around post 13 of body 10 whereby handle 30 rotates about the body here. Post 13 preferably includes ramp 13*a* to spread the handle apart during assembly to fit on post 13 (see also FIG. 13). According to this design, the handle may be installed after the two halves of body 10 are assembled. Handle 30 thus may cover the entire length of the body as seen in FIG. 1.

Figure 9:
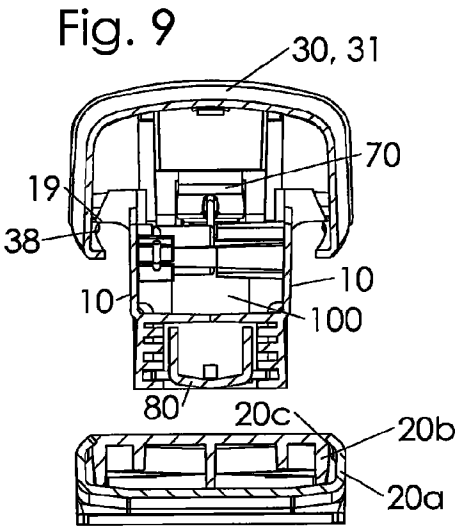
FIG. 9 is a cross-sectional view of the stapler of FIG. 7.

As discussed above, lever 70 provides an upper position stop for handle 30 in FIG. 4. In FIGS. 9, 13, an additional sturdy stop includes flange 38 of handle 30 bumping against tab 19 of the body 10. The top of tab 19 is angled to provide a ramp for snap fitting handle 30 to body 10 at flange 38 during assembly. This snap fit complements the snap fit at the rear of the handle. Handle 30 may have slight resilience to flex slightly for these snap fits. Assembly screws, rivets, roll pins, and like fasteners are not needed, although such fastenings devices may optionally be used.

Figure 7:
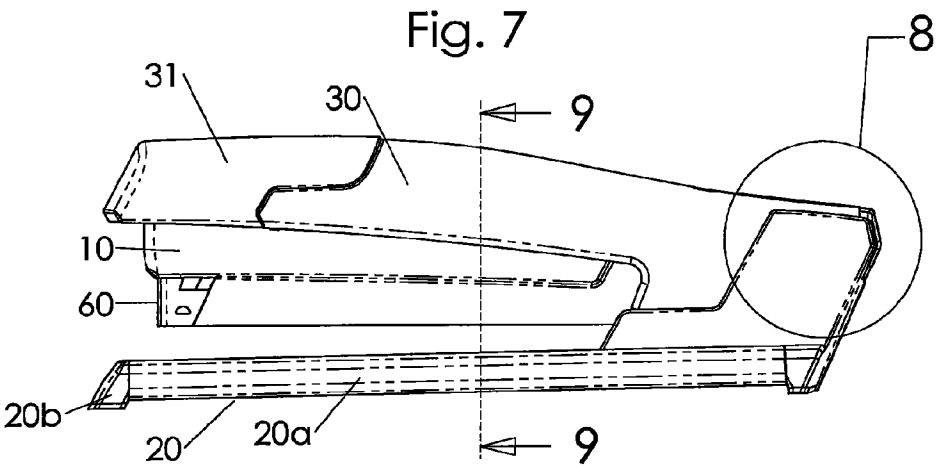
FIG. 7 is a left side elevation of the stapler of the invention.

In the cross-sectional view of FIG. 9, taken along line 9-9 of FIG. 7, the components of base 20 can be seen. In the preferred embodiment, base 20 includes an outer partial sheet metal shell 20*a* and a plastic core 20*b*. Shell 20*a* is snap fitted to core 20*b* to provide a stiffening structure for the base 20. Shell 20*a* extends along a central portion of the base preferably excluding the ends and the sidewall structure near track pull 90. As seen in FIG. 3, core 20*b* is exposed from below at both ends. Thus, the metal shell is a simple, low cost shape.

Figure 14:
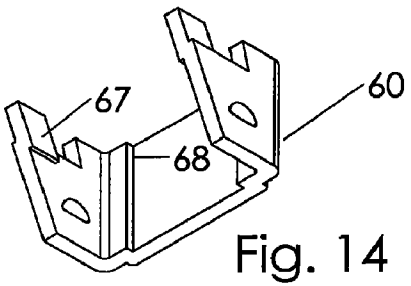
FIG. 14 is a rear perspective view of a nosepiece.

FIG. 14 is a perspective view of nosepiece 60 that is preferably snap fitted to body 10. The nosepiece 60 flexes slightly as it is pressed upward to allow tabs 67 to engage recesses 11 (FIG. 13). Nosepiece 60 preferably forms the front end of the staple track area and fastens the halves of body 10 together in this area. Slot 68 may provide a guide for the staples.

The features of the invention may be used together as illustrated or as separate improvements. For example, the leveraging system may be incorporated into a top-loading stapler. In such a top-loading stapler, body 10 is distinct from a track structure, as the body would pivot up and rearward from the track. The elements of the leveraging system may remain within the pivoting body. Furthermore, the anti-rotation tab of track 80 may be incorporated into a conventional stapler to allow, for example, the bottom loading design shown.

While particular forms of the invention have been described and illustrated, it will be apparent to those skilled in the art that various modifications can be made without departing form the spirit and scope of the invention. Accordingly, it is not intended that the invention be limited except by the appended claims.

The invention claimed is:

1. A stapler for dispensing staples from a staple rack having a front staple and a second staple, comprising:

a body;

a track to guide staples disposed within the body;

a handle movably attached to the body;

a striker to move staples out from the body;

wherein the staple rack is positioned on the track such that the front staple is cantilevered from a front end of the track and the second staple is supported on the track behind the front staple, the front staple being positioned below the striker in a striker highest position;

wherein the stapler undergoes a stapling cycle having two distinct stages, a leveraging stage, the leveraging stage including a location of the handle above the striker moving downward and the striker also moving downward in proportion to motion of the handle, the location of the handle moving substantially faster than the striker in relation to the body, and after an end of the leveraging stage, a non-leveraged stage after the leveraging stage wherein the location of the handle moves toward a lowest position of the handle about 1:1 in relation to the striker; and at the end of the leveraging stage, a top of the front staple is moved to be below a top of the second staple, the front staple remaining substantially confined by the body with a lower leg of the front staple being above a bottom of the body.

2. The stapler of claim 1, wherein a non-leveraged stage of the stapling cycle begins at a pre-determined position of the handle in relation to the body after the leveraging stage, and the staple is ejected from the body during the non-leveraged stage.

3. The stapler of claim 2, wherein a lever links the handle to the striker, a lever front end pivots against a fulcrum location of the body through the leveraging stage, and the lever front end moves downward within the body away from the fulcrum location of the body during the non-leveraged stage of the stapling cycle.

4. The stapler of claim 3, wherein the handle presses the lever at a first fulcrum of the lever through the leveraging stage and the handle presses the lever at a second fulcrum location of the lever after the end of the leveraging stage, the first fulcrum location being further along the length of the body from the striker than the second fulcrum location, and the fulcrum location of the body is in front of the striker and in front of the first and second fulcrums of the lever.

5. The stapler of claim 2, wherein a base is attached to the body and extends along a bottom of the body, an anvil of the base is below the striker, and the staple is ejected against the anvil.

6. The stapler of claim 1, wherein during the leveraging stage, a lever pivots to the body at a lever front end, the lever pivots at a further location against the handle, and the lever operates upon the striker, the lever is selectively pressed at two separate fulcrum locations of the lever, a first fulcrum spaced along a length of the body from a second fulcrum, the lever being pressed at the first fulcrum through the leveraging stage, and the fulcrum location moves whereby the lever is pressed at the second fulcrum after the end of the leveraging stage.

7. The stapler of claim 1, wherein the leveraging stage includes a motion of the striker to break a glue bond between the front staple and the second staple wherein at the end of the leveraging stage, a striker bottom edge is below a ceiling of the track while being substantially closer to the ceiling than to a bottom of the body.

8. The stapler of claim 7, wherein the striker moves about 0.050 to 0.060 inch inclusive from a striker highest position to the end of the leveraging stage.

9. A stapler for dispensing staples from a staple rack contained therein having a front staple and a second staple, comprising:

a body;

a handle movably attached to the body;

a striker to drive staples out from the body;

a track disposed within the body, wherein the staple rack is positioned on the track such that the front staple is cantilevered from a front end of the track and the second staple is supported by the track behind the front staple, and the front staple is positioned below the striker in a striker highest position;

a pivoting lever linked to the striker at one end and trapped within a first and a second spaced apart ribs within the handle at an opposite end, wherein a fulcrum of the lever pivots about a front portion of the handle;

wherein a location of the handle above the striker moves downward and the striker moves downward in proportion to the motion of the handle defining a leveraging stage, the leveraging stage including the location of the handle moving farther than the striker in relation to the body at a ratio of about 2:1, and after an end of the leveraging stage, the location of the handle moves not more than about 1:1 in relation to the striker; and the lever presses the first rib in a rest position of the handle and the lever moves away from the first rib to press the second rib at the end of the leveraging stage wherein rotation of the lever is limited by the respective ribs.

10. The stapler of claim 9, wherein the front staple is positioned below the second staple and out of pressing contact with a working surface at the end of the leveraging stage.

11. The stapler of claim 9, wherein the lever has two fulcrum areas acting against the handle, and wherein the handle presses the lever at a first fulcrum of the lever through the leveraging stage and the handle presses the lever at a second fulcrum location after the end of the leveraging stage, the first fulcrum location being farther along the length of the body from the striker than the second fulcrum location.

12. The stapler of claim 9, wherein the staple rack has a channel form, and the staple track includes two rails supporting the staple rack from underneath and within the channel form of the staple rack.

13. The stapler of claim 9, wherein the lever links the handle to the striker, and a lever front end pivots against a fulcrum location of the body through the leveraging stage; and wherein the fulcrum location of the body is in front of the striker, and the lever front end moves downward within the body away from the fulcrum location of the body during the non-leveraged stage of the stapling cycle.

* * * * *